US007839350B2

(12) United States Patent
Nagai

(10) Patent No.: US 7,839,350 B2
(45) Date of Patent: Nov. 23, 2010

(54) ANTENNA DEVICE

(75) Inventor: Shuichi Nagai, Kyoto (JP)

(73) Assignee: Panasonic Corporation, Osaka (JP)

( * ) Notice: Subject to any disclaimer, the term of this patent is extended or adjusted under 35 U.S.C. 154(b) by 261 days.

(21) Appl. No.: 12/092,739

(22) PCT Filed: Aug. 4, 2006

(86) PCT No.: PCT/JP2006/315469

§ 371 (c)(1),
(2), (4) Date: May 6, 2008

(87) PCT Pub. No.: WO2007/069366

PCT Pub. Date: Jun. 21, 2007

(65) Prior Publication Data

US 2009/0046029 A1 Feb. 19, 2009

(30) Foreign Application Priority Data

Dec. 12, 2005 (JP) ..... 2005-358221

(51) Int. Cl.
*H01Q 1/50* (2006.01)

(52) U.S. Cl. ..... 343/850; 343/700 MS; 343/851; 343/852

(58) Field of Classification Search ..... None
See application file for complete search history.

(56) References Cited

U.S. PATENT DOCUMENTS

| | | | | |
|---|---|---|---|---|
| 4,079,268 | A | 3/1978 | Fletcher et al. | |
| 6,700,462 | B2 | 3/2004 | Nakamura et al. | |
| 6,943,737 | B2 * | 9/2005 | Ryken et al. | 343/700 MS |
| 7,312,763 | B2 * | 12/2007 | Mohamadi | 343/853 |
| 2003/0085836 | A1 | 5/2003 | Mikami et al. | |
| 2003/0186725 | A1 | 10/2003 | Miya et al. | |
| 2006/0045460 | A1 * | 3/2006 | Sangawa et al. | 385/147 |
| 2007/0183515 | A1 | 8/2007 | Lim et al. | |

FOREIGN PATENT DOCUMENTS

| | | |
|---|---|---|
| JP | 4-140905 | 5/1992 |
| JP | 4-253402 | 9/1992 |
| JP | 7-273509 | 10/1995 |
| JP | 8-97620 | 4/1996 |
| JP | 8-195620 | 7/1996 |
| JP | 9-238002 | 9/1997 |
| JP | 10-294616 | 11/1998 |

(Continued)

OTHER PUBLICATIONS

Partial English language translation of JP 2001-060823, Mar. 6, 2001.

(Continued)

*Primary Examiner*—Trinh V Dinh
(74) *Attorney, Agent, or Firm*—Greenblum & Bernstein, P.L.C.

(57) ABSTRACT

An antenna device according to the present invention includes; a plurality of antenna elements; a line which is electro-magnetically connected to each of the antenna elements and is branched from at least one branch point in the line; and filters formed in the line between a first branch point and each of said plurality of antenna elements. Here, the first branch point is the electrically farthest branch point from each of the antenna elements among all branch points.

7 Claims, 11 Drawing Sheets

FOREIGN PATENT DOCUMENTS

| | | |
|---|---|---|
| JP | 11-8893 | 1/1999 |
| JP | 3062593 | 5/2000 |
| JP | 2000-286634 | 10/2000 |
| JP | 2000-341031 | 12/2000 |
| JP | 2001-60823 | 3/2001 |
| JP | 2002-271112 | 9/2002 |
| JP | 2002-271130 | 9/2002 |
| JP | 2003-60404 | 2/2003 |
| JP | 2003-101301 | 4/2003 |
| JP | 3436073 | 6/2003 |
| JP | 2003-337201 | 11/2003 |
| JP | 2005-198335 | 7/2005 |

OTHER PUBLICATIONS

Partial English language translation of JP 2005-198335, Jul. 21, 2005.
Partial English language translation of JP 8-195620, Jul. 30, 1996.
English language Abstract of JP 2001-60823, Mar. 6, 2001.
English language Abstract of JP 2005-198335, Jul. 21, 2005.
English language Abstract of JP 8-195620, Jul. 30, 1996.
English language Abstract of JP 11-68455, Mar. 9, 1999.
English language Abstract of JP 11-8893, Jan. 12, 1999.
English language Abstract of JP 4-140905, May 14, 1992.
English language Abstract of JP 7-273509, Oct. 20, 1995.
English language Abstract of JP 2003-101301, Apr. 4, 2003.
English language Abstract of JP 10-294616, Nov. 4, 1998.
English language Abstract of JP 10-335926, Dec. 18, 1998.
English language Abstract of JP 2000-286634, Oct. 13, 2000.
English language Abstract of JP 2003-337201, Nov. 28, 2003.
English language Abstract of JP 2000-341031, Dec. 8, 2000.
English language Abstract of JP 9-238002, Sep. 9, 1997.
English language Abstract of JP 2003-60404, Feb. 28, 2003.
English language Abstract of JP 2002-271130, Sep. 20, 2002.
U.S. Appl. No. 12/092,741 to Nagai et al., which was filed on Aug. 4, 2006.
English language Abstract of JP 4-253402, Sep. 9, 1992.
English language Abstract of JP 8-97620, Apr. 12, 1996.
English language Abstract of JP 2002-271112, Sep. 20, 2002 and English language translation of drawings Fig.1-Fig.5.
Annotated copy of Figs. 1 and 4 of JP 10-294616.
Annotated copy of Figs. 1-5 of JP 2002-271112.

* cited by examiner

ANTENNA DEVICE

TECHNICAL FIELD

The present invention relates to antenna devices, and more particularly to an antenna device which has a filter for blocking signals in a specific frequency band and is used for a wireless communication device, a radar device for determining a distance from or a position of an object, or the like.

BACKGROUND ART

In recent years, wireless devices, such as wireless communication devices and wireless radar devices, employing spread-spectrum techniques or Ultra Wide Band (UWB) have been examined and utilized. Especially, with the increase of speed and efficiency of the wireless devices, wireless devices using high-frequency waves such as millimeter waves or quasi-millimeter waves have attracted attention. In such wireless devices using the wide-band frequencies, sidelobe occurs in wide frequencies due to frequency diffusion. Therefore, in a structure of such a wireless device, a filter such as a Band-Pass Filter (BPF) which passes only a specific frequency but blocks unnecessary frequencies is required.

In a wireless device for transmitting waves, such a filter is inserted between a transmission antenna and a power amplifier so that waves except frequencies regulated by the Radio Law are not transmitted from the transmission antenna. On the other hand, in a wireless device for receiving waves, such a filter is inserted between a receiving antenna and a Low Noise Amplifier (LNA) so that interference of unnecessary frequencies can be prevented and that the LNA at a next stage can efficiently amplify only waves of a desired frequency band. As explained above, in a structure of a wireless device, a filter and an antenna are connected with each other.

One example of a high frequency filter used in such a wireless device is a filter having a planar distributed constant circuit such as a microstripline (refer to Patent Reference 1 and Patent Reference 2, for example). Here, when the microstripline on a dielectric substrate is formed to have various shapes, coils and capacitors can be formed in a planar distributed constant circuit, thereby achieving the above filter.

In addition, a method is disclosed to form a filter or a feed line together with an antenna on the same substrate (refer to Patent Reference 3, for example).

An antenna radiation pattern and an antenna radiation gain of an antenna device used in a wireless device are crucial factors of deciding performance of the antenna device. In order to achieve a desired antenna radiation gain or radiation pattern, an antenna device is disclosed to have an array antenna structure in which a plurality of antenna elements are arranged.

FIG. 1 is a plan view showing a structure of such a conventional antenna device having an array antenna structure.

The antenna device shown in FIG. 1 includes a plurality of antenna elements 1001, a feed line 1002, and a filter 1040, which are formed on a surface of a dielectric substrate 1004.

The plurality of antenna elements 1001, each of which is a microstrip patch antenna element, form the array antenna structure.

The feed line 1002 forms a microstripline connecting the filter 1050 with the plurality of antenna elements 1001.

A feed source (power source) 1003, which is positioned at a boundary between the filter 1040 and the feed line 1002, feeds power to each of the antenna elements 1001 via the feed line 1002. The line structure in the antenna device shown in FIG. 1 is a parallel feeding structure. In more detail, each length of the feed line 1002 is generally the same between a first branch point 1007 to each antenna element 1001, and the power is fed to each antenna element 1001 in the same phase. Moreover, the antenna device shown in FIG. 1 uses a coplanar feeding scheme, forming the antenna elements 1001 and the feed line 1002 on a surface of the same substrate. Since the coplanar feeding scheme can be realized in the dielectric substrate 1004 having a monolayer structure, the coplanar feeding scheme is quite useful to realize a simple and inexpensive array antenna structure.

In the meanwhile, frequency characteristics of a filter are decided by the number of filter stages in the filter. Therefore, more filter stages can increase an attenuation amount except a transmission band, thereby improving frequency characteristics.

Patent Reference 1: Japanese Unexamined Patent Application Publication No. 9-238002

Patent Reference 2: Japanese Unexamined Patent Application Publication No. 2003-60404

Patent Reference 3: Japanese Unexamined Patent Application Publication No. 2002-271130

DISCLOSURE OF INVENTION

Problems that Invention is to Solve

However, the increase of the filter stages for the filter characteristic improvement results in increase of a filter size (in other words, extension of a line length), which eventually increases an insertion loss (transmission loss). In addition, a used area of the substrate needs to be extended to form the more filter stages, so that a size of the antenna device having such a filter is increased. As explained above, it is difficult to improve filter characteristics without increasing an area and an insertion loss of the antenna device. That is, the conventional antenna device has a problem of difficulty in realizing an antenna device with a small size and a high gain.

In view of the above problems, an object of the present invention is to provide an antenna device with a small size and a high gain, while having a filter.

Means to Solve the Problems

In accordance with an aspect of the present invention for achieving the above object, there is provided an antenna device including: a plurality of antenna elements; a line electro-magnetically connected to each of the plurality of antenna elements, the line being branched from at least one branch point in the line; and filters formed in the line between (i) a first branch point and (ii) each of the plurality of antenna elements, the first branch point being the electrically farthest branch point from each of the plurality of antenna elements.

With the above structure, in the antenna device according to the present invention, a filter is formed between the first branch point and each of the antenna elements. This means that the filter is formed in a region where a line is arranged. Thereby, there is no need for a region dedicated to form the filter, so that extension of the area of the antenna device can be prevented. Furthermore, with the above structure, even if the number of filter stages is increased to improve filter characteristics, there is no need for another region to form an additional filter. Therefore, even in this case, filter characteristics can be improved without extending the area of the antenna device. Still further, with the above structure, the antenna device according to the present invention can prevent increase of an insertion loss due to the forming of the filter. Thereby, according to the present invention, the antenna device with a small size and a high gain can be realized.

Further, it is possible that the plurality of antenna elements are formed on a substrate, the line is formed on the substrate, and the filters are formed on the substrate.

With the above structure, in the antenna device according to the present invention, the antenna elements, the line, and the filter can be formed on the same substrate.

Furthermore, it is possible that each of the plurality of antenna elements is a microstrip antenna formed on a surface of the substrate, the line is a microstripline formed on the surface of the substrate, and each of the filters is a microstrip filter formed on the surface of the substrate.

With the above structure, in the antenna device according to the present invention, the antenna elements, the line, and the filter can be formed on a surface of a monolayer substrate. Thereby, the antenna device according to the present invention can be manufactured simply and inexpensively.

Still further, it is possible that the substrate is a multilayer substrate, and the filter is a stack filter.

With the above structure, in the antenna device according to the present invention, the filter is formed on a multilayer substrate. Thereby, it is possible to increase a design flexibility of the antenna device according to the present invention.

Still further, it is possible that the line has a plurality of the branch points, and the filters include a first filter and a second filter, wherein the first filter is inserted in the line between a second branch point and the first branch point, the second branch point being different from the first branch point, and the second filter is inserted in the line between the second branch point and each of the plurality of antenna elements.

With the above structure, in the antenna device according to the present invention, each of the filters is formed at a line part positioned near to a root of the line that has a plurality of branch points (in other words, each of the filters is formed at a line part electrically far apart from each antenna element). Thereby, the antenna device according to the present invention can reduce the number of filters and an area of the filters.

Still further, the antenna device may further include a wave absorber formed above one of the line and the filter.

With the above structure, in the antenna device according to the present invention, the wave absorber eliminates unnecessary emission from the feed line or the filter. Thereby, the antenna device according to the present invention can prevent that waves emitted from the filters interfere waves transmitted from the antenna elements. Thereby, the antenna device according to the present invention can achieve satisfactory antenna gain and antenna radiation pattern.

Still further, the antenna device may further include a photonic crystal structure formed above one of the line and the filter.

With the above structure, in the antenna device according to the present invention, the photonic crystal structure blocks unnecessary emission from the feed line or the filter. Thereby, it is possible to prevent that waves emitted from the line or the filters interfere waves transmitted from the antenna elements. As a result, the antenna device according to the present invention can achieve satisfactory antenna gain and antenna radiation pattern.

The antenna device may further include an insulation layer between (i) one of the line and the filter and (ii) the wave absorber.

With the above structure, in the antenna device according to the present invention, the wave absorber is electrically insulated from the filter or the line. As a result, the antenna device according to the present invention can prevent impedance change due to setting of the wave absorber.

Effects of the Invention

The present invention can provide an antenna device with a small size and a high gain.

NUMERICAL REFERENCES

| | |
|---|---|
| 100, 600, 800, 900 | antenna device |
| 101a-101h, 1001 | antenna element |
| 102, 402, 602, 1002 | feed line |
| 103, 1003 | feed source |
| 104, 304, 404, 1004 | substrate |
| 107-113, 1007 | branch point |
| 121-130, 621-626, 921, 1040 | filter |
| 201, 202 | waveform |
| 360 | stack filter |
| 403 | contact hole |
| 801-806, 901 | wave absorber |
| 851 | insulation layer |

BEST MODE FOR CARRYING OUT THE INVENTION

The following describes the antenna device according to the present invention with reference to the drawings.

First Embodiment

In the antenna device according to the first embodiment, filters are inserted in a feed line for feeding power to a plurality of antenna elements, which makes it possible to prevent from having a region dedicated to form the filters. Thereby, it is possible to reduce a size of the antenna device.

Figure 2:
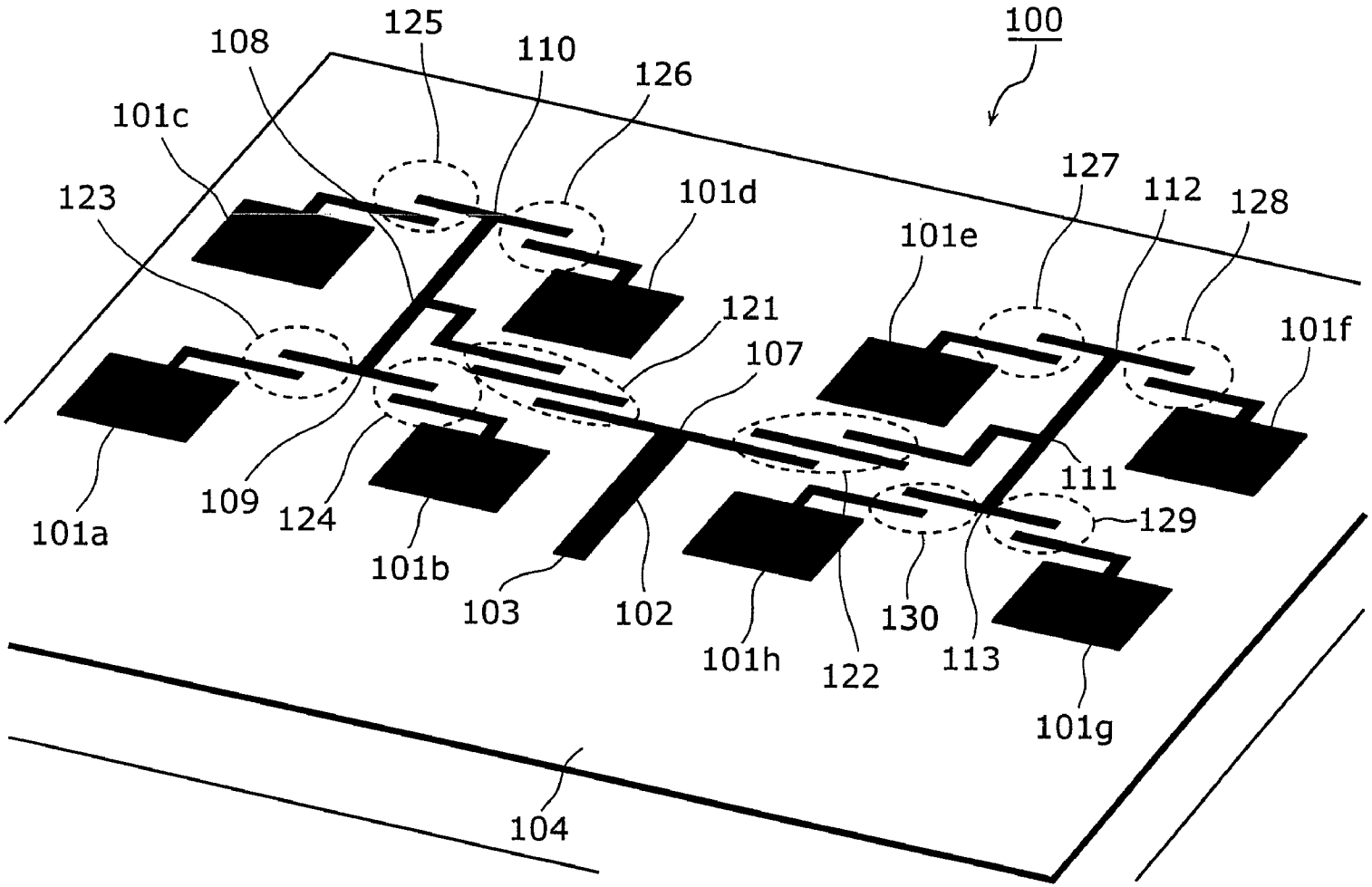
FIG. 2 is a perspective view of an antenna device according to the first embodiment.

FIG. 2 is a perspective view showing a structure of the antenna device according to the first embodiment.

The antenna device 100 shown in FIG. 2 is an antenna device having an array antenna structure for transmitting and receiving radio waves. The antenna device 100 includes a substrate 104, a plurality of antenna elements 101*a* to 101*h*, a feed line 102, a feed source 103, and filters 121 to 130.

The substrate 104 is a monolayer substrate made of dielectric substance. On the rear surface of the substrate 104, a ground conductor is formed. For example, the substrate 104 is made of Teflon™ or the like.

Each of the plurality of antenna elements 101*a* to 101*h* is a planar microstrip patch antenna formed on a surface of the substrate 104. For example, each of the plurality of antenna elements 101*a* to 101*h* is an approximately 3-mm-square.

The feed line 102 is a line which electro-magnetically connects the feed source 103 with the plurality of antenna elements 101*a* to 101*h*. The feed line 102 is branched from branch points in the line. The feed line 102 is a microstripline formed on the surface of the substrate 104. Here, a matching structure between the antenna elements 101*a* to 101*h* and the feed line 102 is a planar structure.

The feed source 103 is a terminal connected to a chip or the like. When transmitting waves, the feed source 103 receives power or signals fed to the array antennas. On the other hand, when receiving waves, the feed source 103 outputs power or signals from the antenna elements 101*a* to 101*h*. Here, the feed line structure of the antenna device 100 employs a tree feeding scheme.

The filters 121 to 130 are planar microstrip parallel coupled band-pass filters formed on the surface of the substrate 104. The filters 121 to 130 are electro-magnetically connected to the feed line 102. Each of the filters 121 and 122 is a microstrip parallel coupled band-pass filter having two stages. Each of the filters 123 to 130 is a microstrip parallel coupled band-pass filter having a single stage. For example, each of the filters 121 to 130 is a band-pass filter for blocking signals except signals having frequencies of 20 GHz to 30 GHz. The antenna elements 101*a* to 101*h*, the feed line 102, and the filters 121 to 130 are made of copper, for example.

In the antenna device having an array antenna structure in which a plurality of antenna elements are arranged, each line length of a signal path is the same between each antenna element and the feed source 103 so that signal transmission between each antenna element and feed source 103 can be synchronized. The feed line 102 is arranged so that the feed line 102 has a plurality of branch points 107 to 113 and that each line length of a signal path between each antenna element and the feed source 103 is the same. In short, each line length of a signal path is the same between the first branch point 107 and each antenna element.

The feed line 102 adjacent to the feed source 103 is branched into two branches from the first branch point 107 which is the electrically farthest from each antenna element among all branch points (in other words, a line path of the feed line 102 from each antenna element to the first branch point 107 is the longest among all branch points). One branch of the feed line 102 branched from the first branch point 107 is connected to one side of the filter 121, and the other branch is connected to one side of the filter 122. The feed line 102 connected to the other side of the filter 121 is branched from the second branch point 108 into two branches. Each feed line 102 branched from the second branch point 108 is further branched from the third branch point 109 or 110 into two branches. The feed line 102 branched from the third branch point 109 or 110 is connected to one side of the filter 123, 124, 125, or 126. The other side of the filter 123, 124, 125, or 126 is connected via the feed line 102 to a corresponding antenna element 101*a*, 101*b*, 101*c*, or 101*d*. Likewise, the feed line 102 connected to the other side of the filter 122 is branched from the second branch point 111 into two branches. Each feed line 102 branched from the branch point 111 is further branched from the third branch point 112 or 113 into two branches. The feed line 102 branched from the third branch point 112 or 113 is connected to one side of the filter 127, 128, 129, or 130. The other side of the filter 127, 128, 129, or 130 is connected via the feed line 102 to a corresponding antenna element 101*e*, 101*f*, 101*g*, or 101*h*.

As described above, the antenna device 100 according to the first embodiment has the filters 121 to 130 within the line of the feed line 102. More specifically, the filters 121 to 130 are inserted in the feed line 102 between the first branch point 107 and the respective antenna elements 101*a* to 101*h*.

As a result, on each path for transmitting power and signals between the feed source 103 and each of the antenna elements 101*a* to 101*h*, a band-pass filter having three stages is formed. For example, on the path between the feed source 103 and the antenna element 101*a*, the two-stage filter 121 and the single-stage filter 123 are formed.

Moreover, as explained previously, in the conventional antenna device having an array antenna structure, each line length of a signal path should be the same between each antenna element and the feed source 103, which results in a problem of the area extension for a region in which the feed line 102 is arranged. In the antenna device 100 according to the first embodiment, however, the filters are formed within the area in which the feed line 102 is arranged, so that there is no longer need for a region dedicated to form the filters. Therefore, it is possible to reduce an area of the antenna device.

Furthermore, the microstrip parallel coupled band-pass filters have a problem of an insertion loss depending on a line length. Therefore, when the filters are formed in a region different from the region in which the feed line 102 is arranged in the same manner as the conventional antenna device, an insertion loss depending on a line length of the filter is added to an insertion loss of the path to each antenna element. In the antenna device 100 according to the first embodiment, however, the filters are formed in a region in which the feed line 102 is arranged, so that the insertion loss due to the forming of the filters is not increased.

Figure 3:
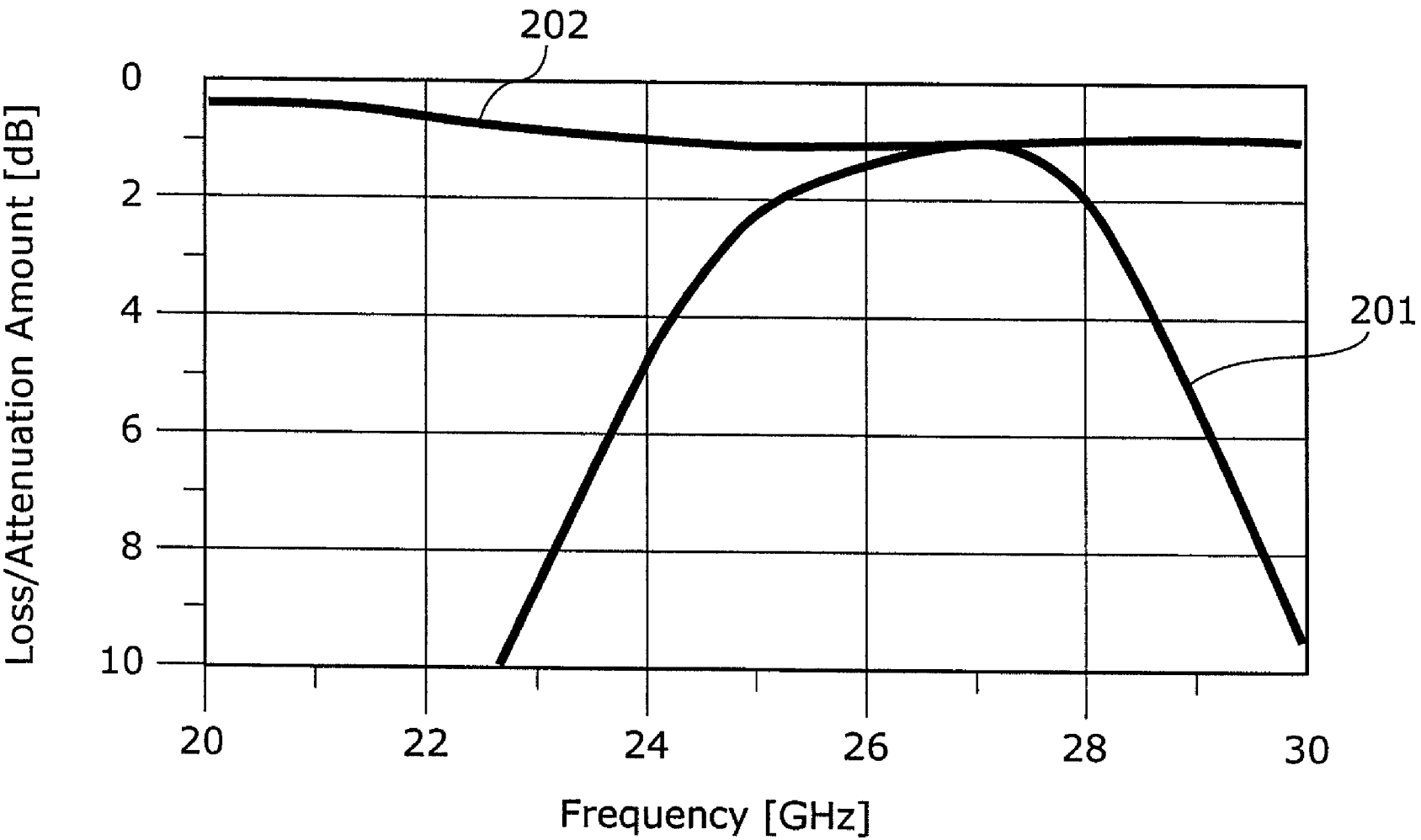
FIG. 3 is a graph showing an insertion loss versus a frequency of a filter and a line.

FIG. 3 is a graph showing an insertion loss versus a frequency of the band-pass filters and the microstripline. A waveform 201 shown in FIG. 3 represents an insertion loss versus a frequency regarding a three-stage microstrip parallel coupled band-pass filter. A waveform 202 represents an insertion loss versus a frequency regarding the microstripline having the same length as the band-pass filter of the waveform 201.

As shown in FIG. 3, around a frequency of 27 GHz, the insertion losses of the waveform 201 and the waveform 202 are almost the same. This means that, within a range of frequencies passing the band-pass filter, the insertion loss is not changed as far as a length of the microstripline is equal to a length of the filter. Therefore, even if a part of the feed line 102 is replaced by the filter, an insertion loss in the entire line (wiring) is not changed.

Accordingly, in the antenna device 100 of the first embodiment, the filters are formed in a region in which the feed line 102 is arranged. Thereby, there is no longer need to have a region dedicated to form the filters. As a result, it is possible to prevent the extension of the area of the antenna device 100. Furthermore, even if the number of filter stages is increased to improve filter characteristics, there is no need for a region to form an additional filter. Therefore, even in this case, filter characteristics can be improved without extending the area of the antenna device 100. Still further, the antenna device 100 according to the first embodiment can prevent increase of an insertion loss due to the forming of the filters. Thereby, it is possible to realize the antenna device with a high gain.

It should be noted that the above has described the antenna device according to the first embodiment, but the present invention is, of course, not limited to this embodiment.

For example, although it has been described that the antenna device 100 includes eight antenna elements 101*a* to 101*h*, the number of the antenna elements is not limited to only eight but may be any number of two or more.

It should also be noted that the antenna elements 101*a* to 101*h* have been described as planar microstrip patch antennas, but they may be other antenna elements different from the described microstrip antennas.

It should also be noted that the feed line 102 has been described as the microstripline, but the feed line 102 may be a line having other structure.

It should also be noted that it has been described that each of the filters 121 and 122 is formed between the first branch point 107 and the second branch point 108 or 111 and that each of the filters 123 to 130 is formed between the corresponding third branch point 109, 110, 112, or 113 and the corresponding antenna element among the antenna elements 101*a* to 101*h*, but the branching structure is not limited to this. For example, a filter may be formed between the second branch point 108 and the third branch point 109 or 110. It is also possible to form a filter at one of the following positions: between the first branch point 107 and the branch point 108 or 111; between the second branch point 108 (111) and the third branch point 109 or 110 (112 or 113); and between the third branch point 109 (110, 112, or 113) and an antenna element 101*a* or 101*b* (101*c* to 101*h*). It is further possible to form a filter in any combination of the above positions.

It should also be noted that it has bee described that the filters 121 and 122 have the same structure and the filters 123 to 130 have the same structure so that filters having the same characteristics can be formed between the antenna elements 101*a* to 101*h* and the feed source 103, but these filters may have respective different structures.

It should also be noted that each of the filter 121 to 130 has been described to have one or two stages, but the number of stages of the filter may be variously combined.

Figure 4:
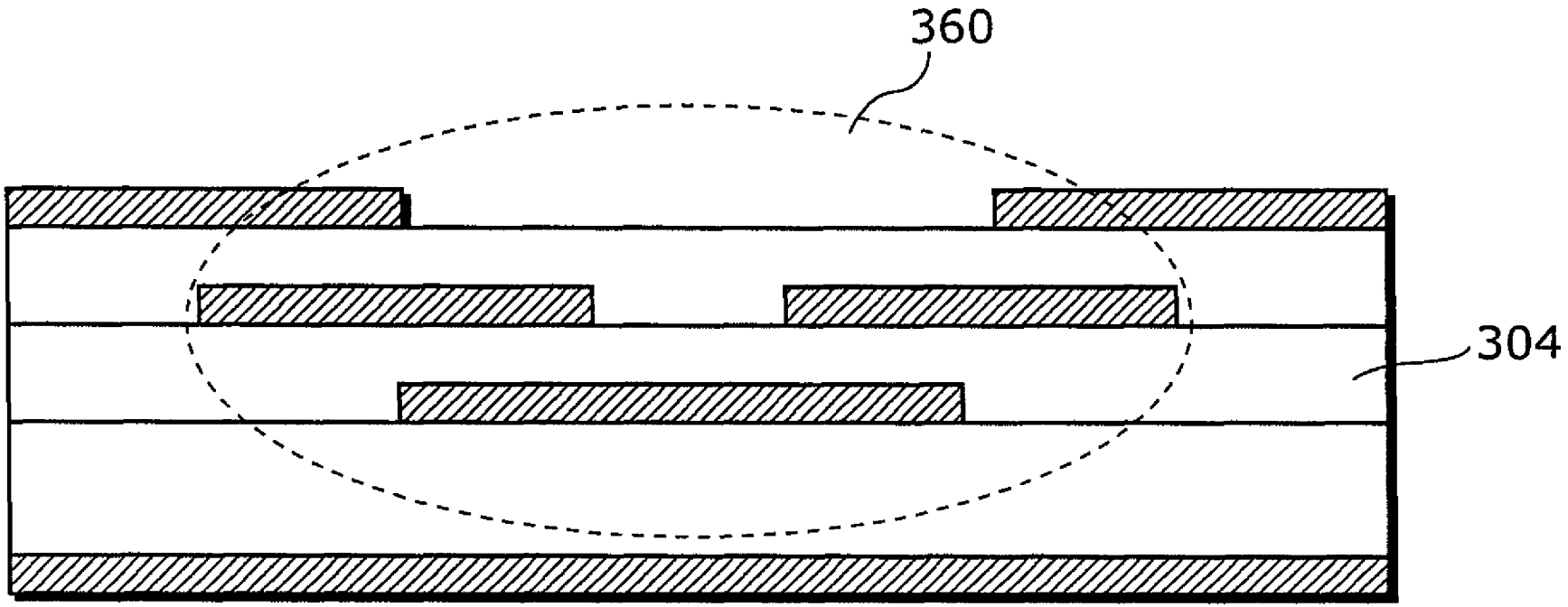
FIG. 4 is a cross-sectional view of a filter having a stack structure.

It should also be noted that each of the filters 121 to 130 has been described to have a planar structure, but the structure is not limited to the above. It should also be noted that the substrate 104 has been described to be a monolayer substrate, but the substrate 104 may be a multilayer substrate. For example, each of the filters 121 to 130 may be a filter having a stack structure. FIG. 4 is a cross-sectional view of such a filter having a stack structure. As shown in FIG. 4, a stack filter 360 may be made of conductors formed in respective layers of a multilayer substrate 304 having a plurality of layers.

Figure 5:
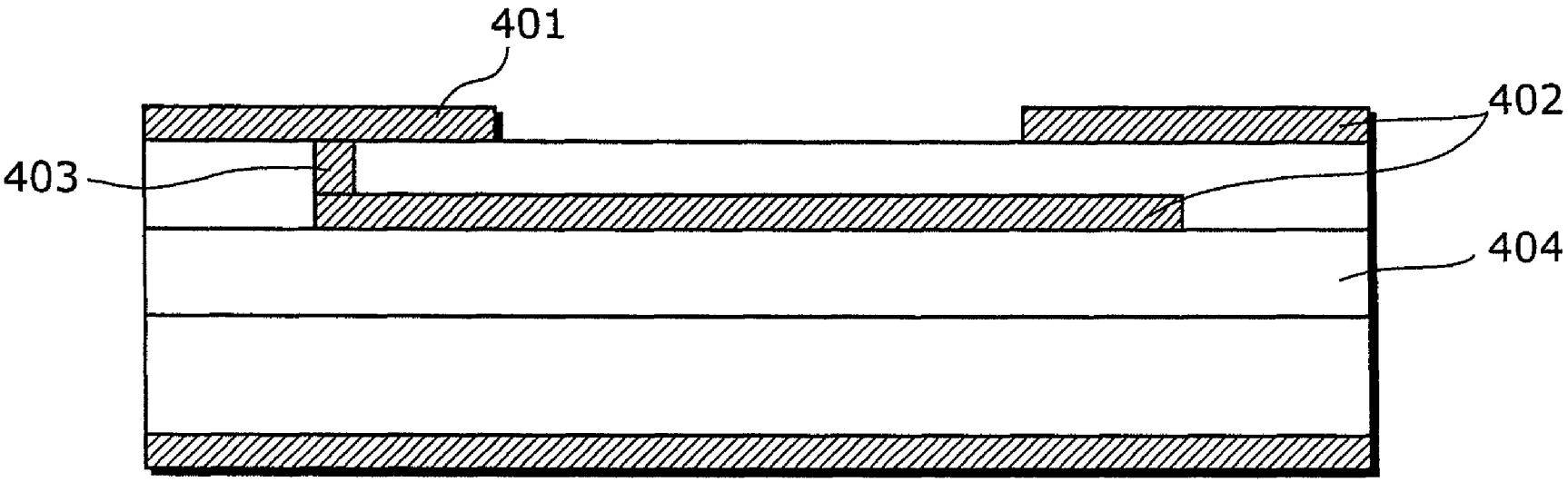
FIG. 5 is a cross-sectional view of an antenna device whose matching structure is a space structure.

It should also be noted that the matching structure between the antenna elements 101 and the feed line 102 has been described to be a planar structure, but the matching structure may be a space structure such as a slot feeder or a rear-surface feeder. FIG. 5 is a cross-sectional view of the antenna device whose matching structure is a space structure. As shown in FIG. 5, it is also possible that feed line 402 is formed between layers of a stack substrate 404 and that an antenna element 401 is connected to a feed line 402 via a contact hole 403.

It should also be noted that the feed line structure has been described to employ the tree feeding scheme, but any other line scheme may be used.

Figure 6:
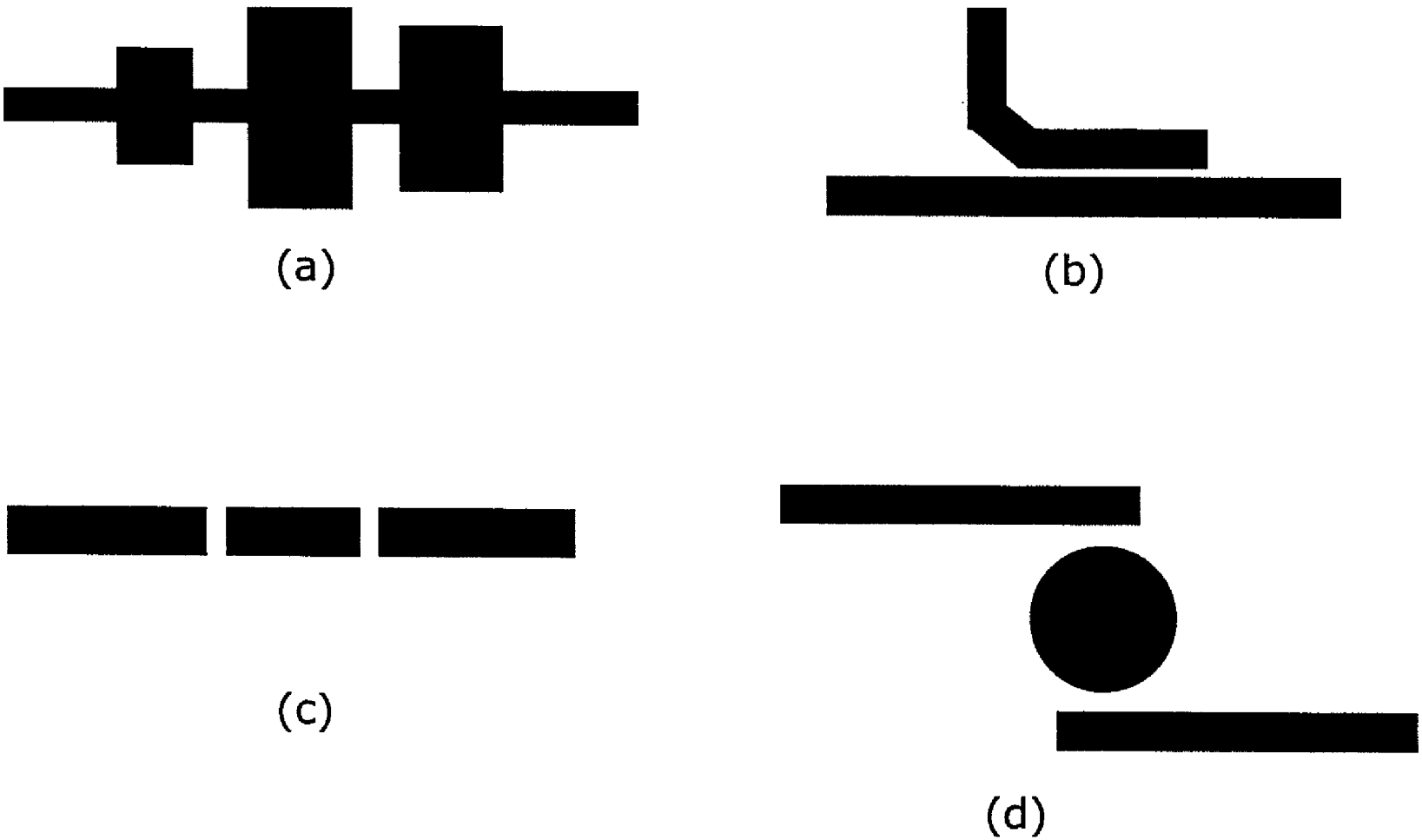
FIG. 6 is a plan view showing structures of a low-pass filter and a band-rejection filter.
Figure 7:
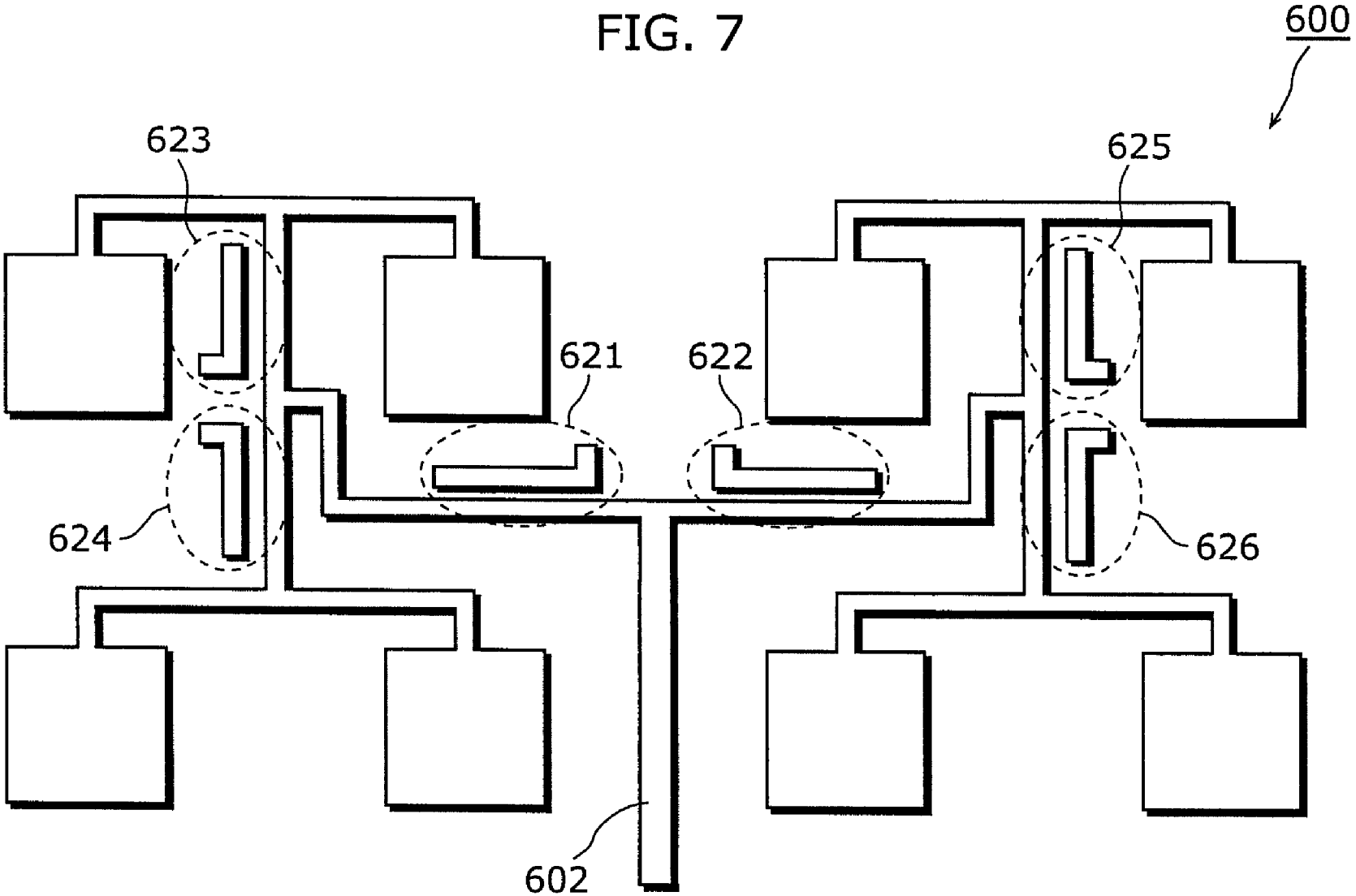
FIG. 7 is a plan view of the antenna device according to the first embodiment, in the case of using a band-rejection filter.
Figure 8:
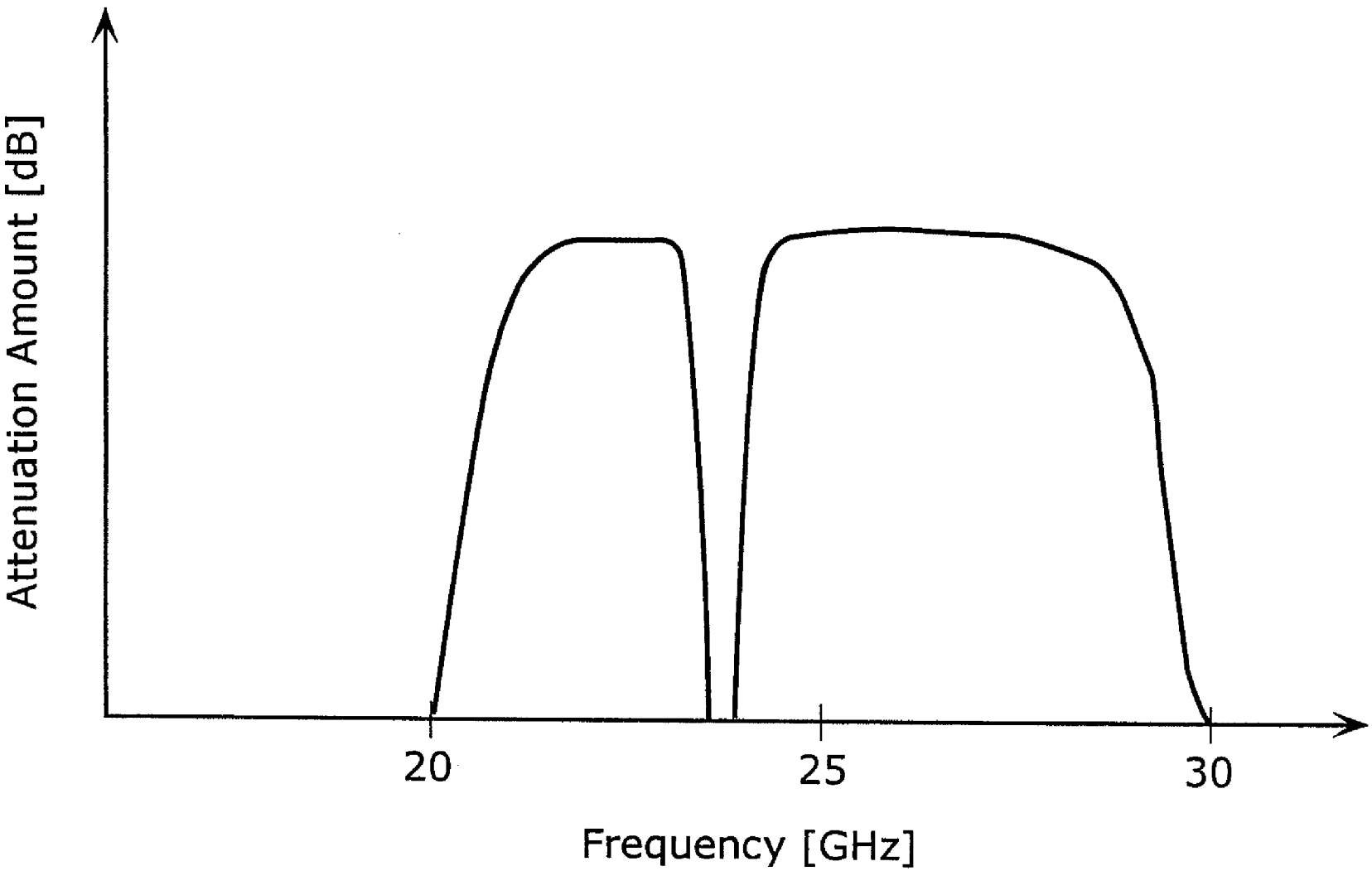
FIG. 8 is a graph showing an attenuation amount of signals versus a frequency regarding a band-pass filter and a band-rejection filter.

It should also be noted that the filters 121 to 130 have been described to be the planar microstrip parallel coupled band-pass filters, but these filters are not limited to the above. For example, the filters 121 to 130 may be low-pass filters or band-rejection filters for blocking signals in a specific frequency region. FIG. 6(*a*) is a plan view showing a structure of a low-pass filter. FIG. 6(*b*) to (*d*) are plan views each showing a structure of a band-rejection filter. FIG. 7 is a plan view showing a structure of an antenna device in the case of using the band-rejection filter shown in FIG. 6(*b*). It is also possible, as an antenna device 601 shown in FIG. 7, to form a plurality of band-rejection filters 621 to 626 in a region in which feed line 602 is arranged. It should also be noted that the filters 121 to 130 may be combinations of various kinds of filters. For example, it is possible to connect a band-pass filter and a band-rejection filter in series. FIG. 8 is a graph showing characteristics of an attenuation amount of signals versus a frequency, in the case of using a band-pass filter and a band-rejection filter. For example, a band-pass filter blocks signals having frequencies except frequencies of 20 GHz to 30 GHz, and a band-rejection filter blocks signals having frequencies except frequencies of around 24 GHz.

It should also be noted that the substrate 104 has described to be made of dielectric substance, but the substrate 104 may be made of any other material. For example, the substrate 104 may be an alumina substrate, a ceramic substrate, or the like.

Second Embodiment

In an antenna device according to the second embodiment, wave absorbers are formed above the filters, thereby reducing unnecessary emission from the filters. Thereby, transmission characteristics of the antenna device can be improved.

Figure 9:
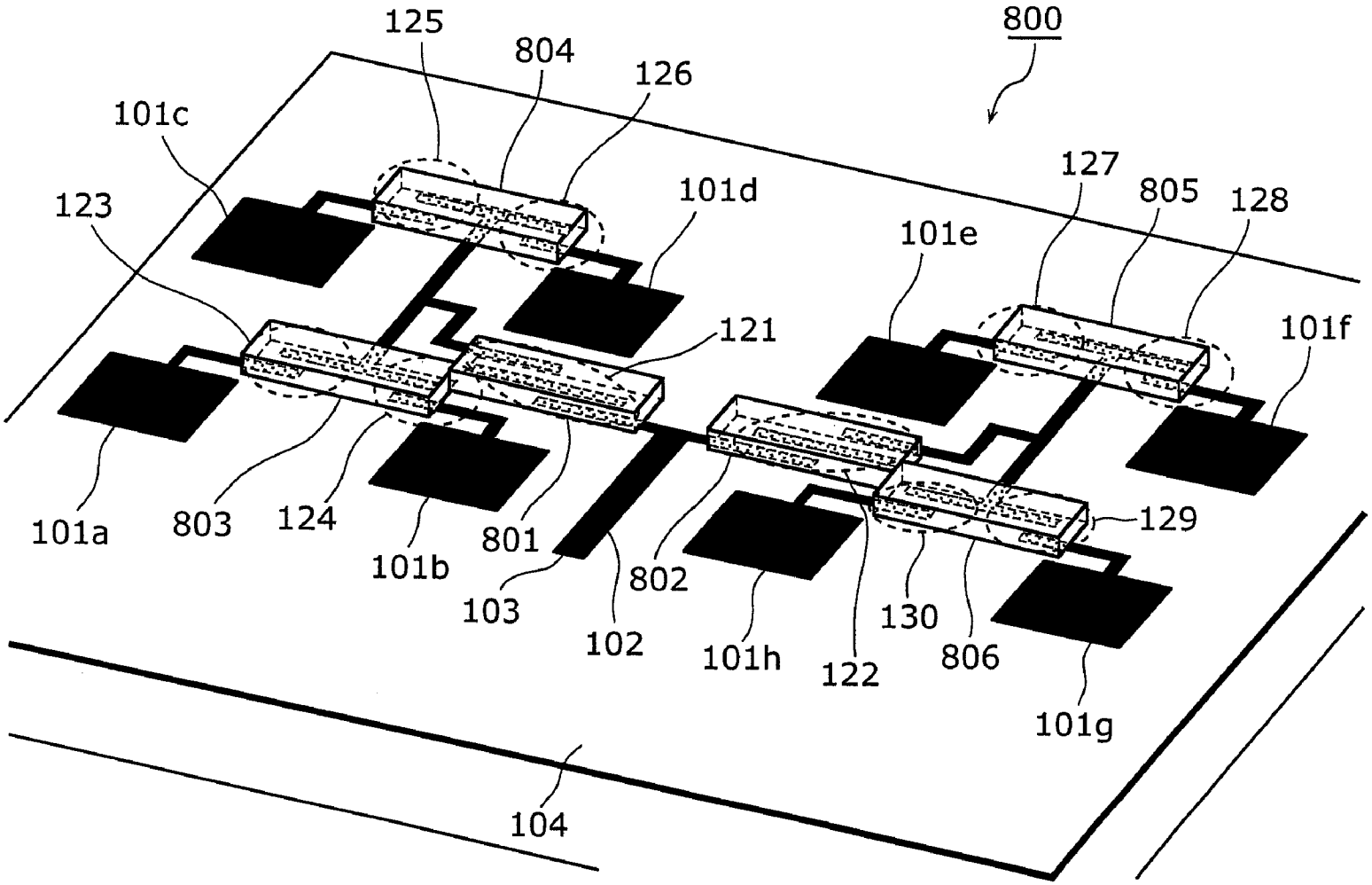
FIG. 9 is a perspective view of an antenna device according to the second embodiment.

FIG. 9 is a perspective view showing a structure of the antenna device according to the second embodiment. Here, the reference numerals of FIG. 2 are assigned to identical elements of FIG. 9, so that the detailed explanation of these identical elements is not given again below.

An antenna device 800 shown in FIG. 9 differs from the antenna device 100 shown in FIG. 2 in that wave absorbers 801 to 806 are formed above the filters 121 to 130, respectively.

Each of the wave absorbers 801 to 806 converts radio waves into heat by using a specific material, thereby not passing waves of a specific frequency. The wave absorbers may be any known art, and various wave absorbers are in the market. For example, there are wave absorbers using a carbon resistance loss, a magnetism loss of ferrite or the like, and wave absorbers using a dielectric loss of a dielectric film.

When the antenna elements 101*a* to 101*h* and the filters 121 to 130 are formed on the same plane, unnecessary emission from the filters 121 to 130 or the feed line 102 sometimes affects an transmission pattern of the antenna elements.

The antenna device 801 shown in FIG. 9 eliminates the unnecessary emission of the filters 121 to 130 using the wave absorbers 801 to 806. Thereby, it is possible to prevent that waves emitted from the filters 121 to 131 interfere waves transmitted from the antenna elements 101*a* to 101*h*. As a result, even if the antenna elements 101*a* to 101*h* are formed with the filters 121 to 130 on the same plane, it is possible to achieve satisfactory antenna gain and antenna radiation pattern.

It should be noted that the wave absorbers have been described to form only above the filters 121 to 130, but the arrangement of the wave absorbers is not limited to the above. For example, the wave absorbers may be arranged above a curbed part, a branched part, or an impedance converted part, where a line width is changed, of the feed line, since unnecessary emission in a high frequency range is large at such a part. Moreover, in a high frequency range, unnecessary emission is large even in the line itself. Therefore, in the case of the coplanar feeding scheme, or the like, the wave absorbers may be formed to cover the entire feed line 102.

Instead of the wave absorbers, it is also possible to arrange metals for blocking unnecessary emission, above the filters 121 to 130 or the feed line 102. It is further possible to arrange, instead of the wave absorbers, photonic crystal structures having a function of blocking radio waves, above the filters 121 to 130 or the feed line 102.

Figure 11:
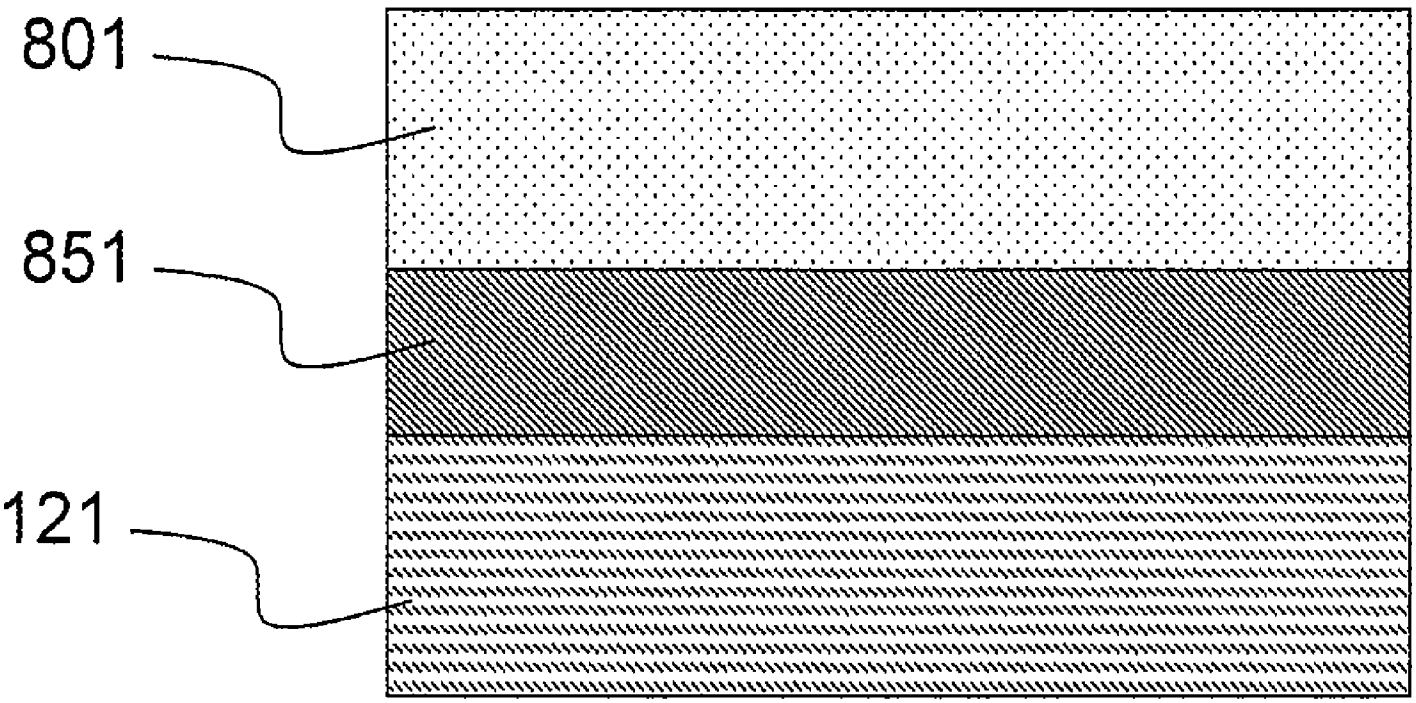
FIG. 11 is a cross-sectional view of an insulation layer between a wave absorber and a filter.

It should also be noted that, in order to prevent impedance change resulting from the setting of the wave absorbers 801 to 806 or the photonic crystal structures, an insulation layer or a dielectric layer may be inserted between (i) each of the wave absorbers 801 to 806 or each of the photonic crystal structures and (ii) the feed line 102 or the each of the filters 121 to 130. FIG. 11 is a cross-sectional view showing an insulation layer 851 between the wave absorber 801 and the filter 121.

Figure 1:
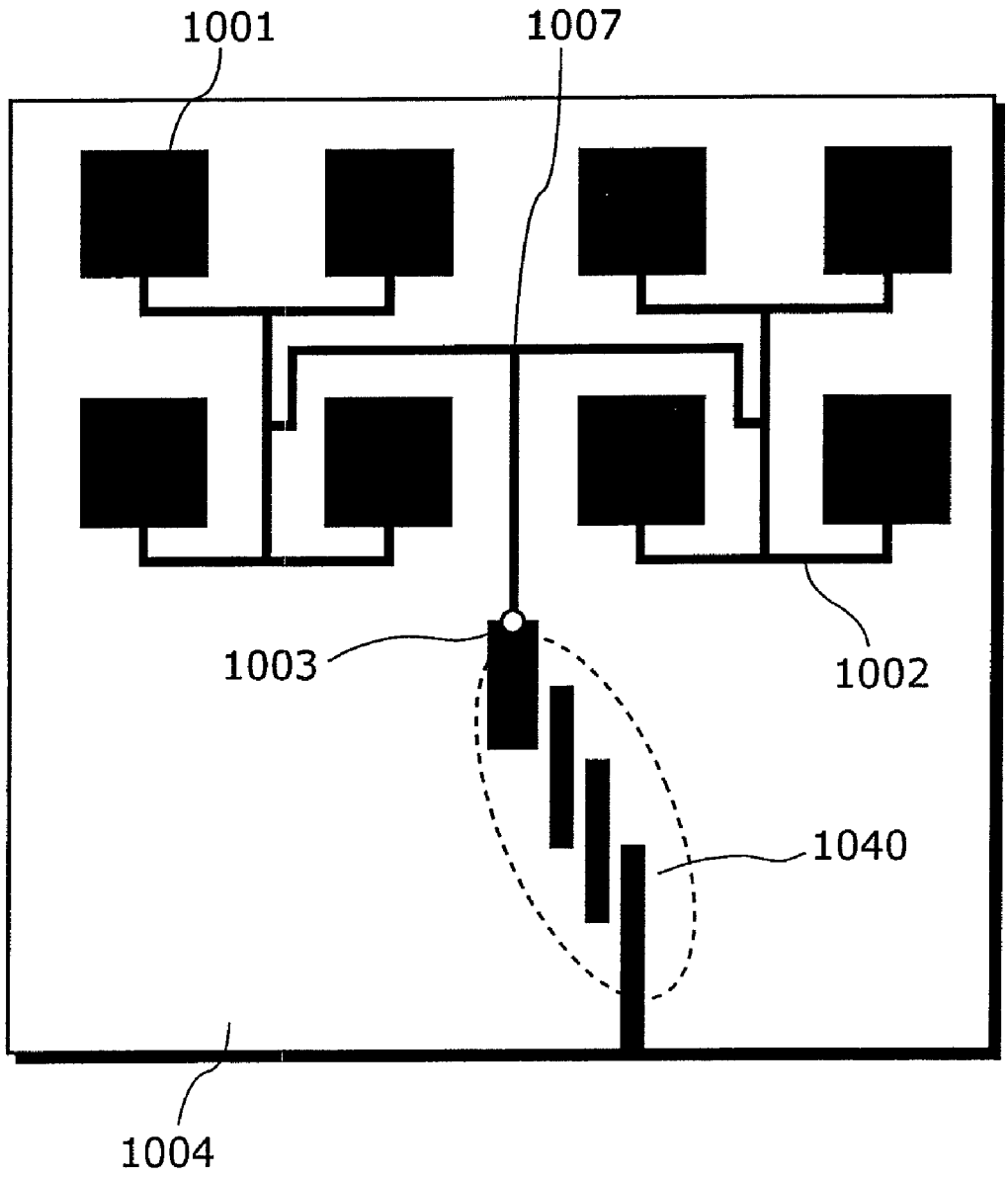
FIG. 1 is a plan view of the conventional antenna device.
Figure 10:
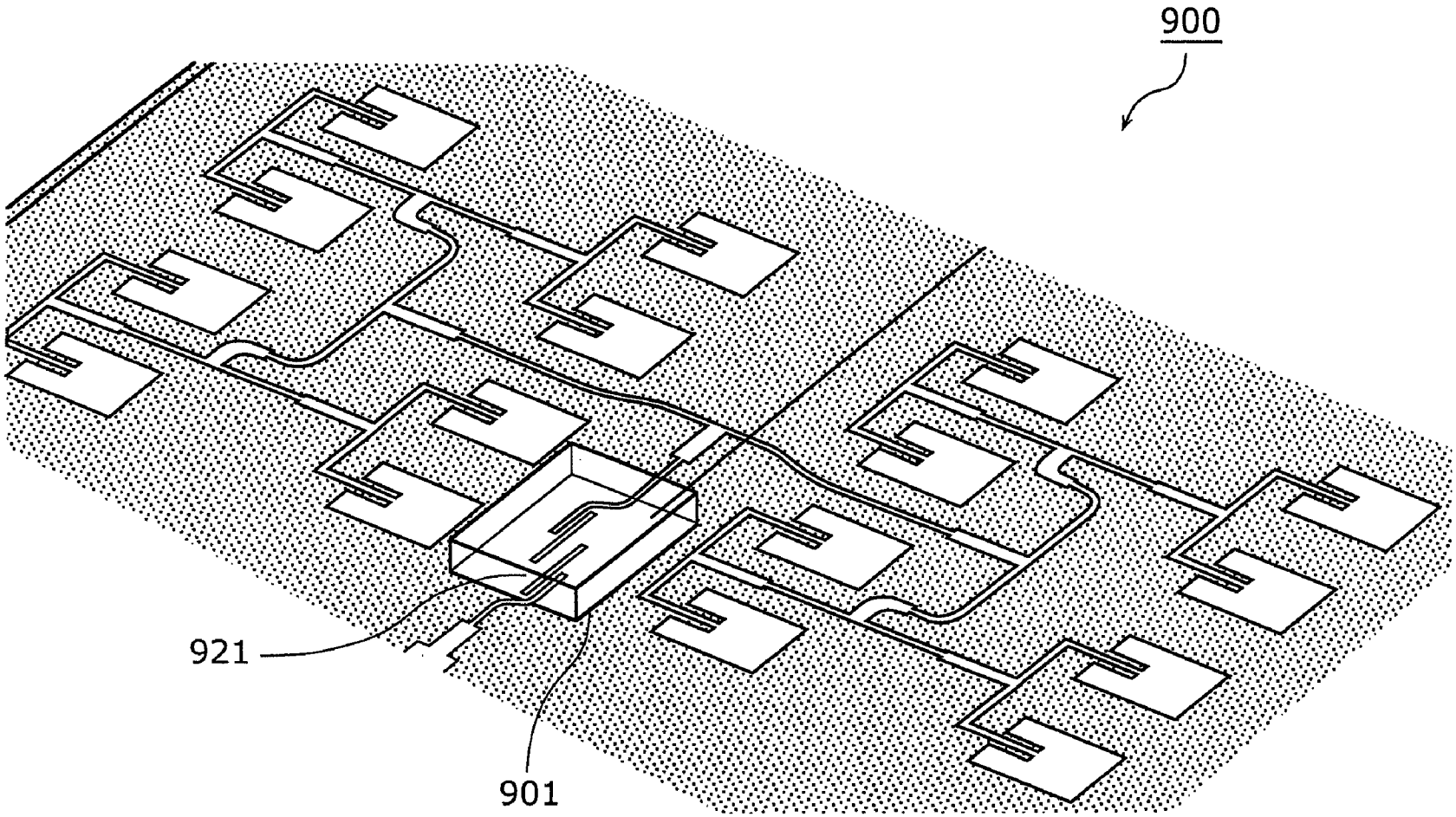
FIG. 10 is a perspective view of an antenna device in which a wave absorber is formed in the conventional antenna device.

It should also be noted that a wave absorber or a photonic crystal structure may be formed above the filter or the feed line 1002 of the conventional antenna device as shown in FIG. 1 in which the filter is not formed in a region in which the feed line 1002 is arranged. FIG. 10 is a perspective view of an antenna device in which a wave absorber is formed above the filter in the conventional antenna device. In an antenna device 900 shown in FIG. 10, a wave absorber 901 is formed above a filter 921. Thereby, the wave absorber 901 can eliminate unnecessary emission from the filter 921.

INDUSTRIAL APPLICABILITY

The present invention can be used as an antenna device, and more particularly as an antenna device used in a wireless communication device or a radar device employing high frequencies.

The invention claimed is:

1. An antenna device comprising:

a plurality of antenna elements;

a line electro-magnetically connected to each of said plurality of antenna elements, said line having a plurality of branch points, including a first branch point and a second branch point; and filters formed in said line between (i) the first branch point and (ii) each of said plurality of antenna elements, the first branch point being the electrically farthest branch point from each of said plurality of antenna elements, wherein said filters include a first filter and a second filter, wherein said first filter is inserted in said line between the second branch point and the first branch point, the second branch point being different from the first branch point, and said second filter is inserted in said line between the second branch point and each of said plurality of antenna elements.

2. The antenna device according to claim 1, wherein said plurality of antenna elements are formed on a substrate, said line is formed on said substrate, and said filters are formed on said substrate.

3. The antenna device according to claim 2, wherein each of said plurality of antenna elements is a microstrip antenna formed on a surface of said substrate, said line is a microstripline formed on the surface of said substrate, and each of said filters is a microstrip filter formed on the surface of said substrate.

4. The antenna device according to claim 2, wherein said substrate is a multilayer substrate, and each of said filters is a stack filter.

5. The antenna device according to claim 1, further comprising a wave absorber formed above said line or one of said filters; and an insulation layer formed between (i) said line or one of said filters, and (ii) said wave absorber.

6. The antenna device according to claim 1, further comprising a photonic crystal structure formed above said line or one of said filters.

7. An antenna device comprising:

a plurality of antenna elements formed on a surface of a substrate;

a feed line electro-magnetically connected to each of said plurality of antenna elements, said feed line having a plurality of branch points, including a first branch point and a second branch point;

a plurality of filters electro-magnetically connected to said feed line and formed between (i) the first branch point and (ii) each of said plurality of antenna elements, the first branch point being the electrically farthest branch point from each of said plurality of antenna elements; and a wave absorber formed above said feed line or one of said filters, wherein said filters include a first filter and a second filter, wherein said first filter is inserted in said feed line between the second branch point and the first branch point, the second branch point being different from the first branch point, and said second filter is inserted in said feed line between the second branch point and each of said plurality of antenna elements.

* * * * *